United States Patent [19]

Logue et al.

[11] Patent Number: 4,568,279

[45] Date of Patent: Feb. 4, 1986

[54] MUFFLE FURNACE FOR CONTINUOUS HEAT TREATMENT

[75] Inventors: Michel Logue, Ste Foy-les-Lyon; Maurice Sadzot, Chamonix Mont Blanc, both of France

[73] Assignee: Societe des Electrodes et Refractaires Savoie, Courbevoie, France

[21] Appl. No.: 708,519

[22] Filed: Mar. 5, 1985

[30] Foreign Application Priority Data

Mar. 14, 1984 [FR] France ..... 84 04330

[51] Int. Cl.[4] ..... F27B 9/00; F27B 11/00

[52] U.S. Cl. ..... 432/206; 432/72; 432/153; 432/143; 432/144

[58] Field of Search ..... 432/59, 132, 133, 136, 432/143, 144, 153, 184, 188, 202, 206

[56] References Cited

U.S. PATENT DOCUMENTS

| | | | |
|---|---|---|---|
| 901,956 | 10/1908 | Creighton | 432/206 |
| 1,875,365 | 9/1932 | Begeman | 432/153 |
| 2,026,737 | 1/1936 | Houze, Sr. | 432/153 |
| 2,463,222 | 3/1949 | Vaughan | 432/206 |
| 2,939,695 | 6/1960 | Gates | 432/143 |
| 3,540,710 | 11/1970 | Yamagishi | 432/206 |
| 3,603,570 | 9/1971 | Galeone | 432/206 |
| 3,658,016 | 4/1972 | Parker | 432/144 |
| 3,869,249 | 3/1975 | Frische | 432/133 |
| 4,217,090 | 8/1980 | Whike et al. | 432/72 |
| 4,255,136 | 3/1981 | Suzuki et al. | 432/143 |
| 4,285,325 | 8/1981 | Belloff | 432/72 |

*Primary Examiner*—Henry C. Yuen

*Attorney, Agent, or Firm*—Dennison, Meserole, Pollack & Scheiner

[57] ABSTRACT

This invention relates to a muffle furnace, for continuous heat treatment during passage of material therethrough, of products, the production cycle of which includes a treatment of predetermined duration at a temperature which may be about 1100° to about 1150° C., which furnace is heated by a flame producing burner without the combustion gases directly contacting the products to be treated. This furnace comprises: an inlet zone provided with a means for preheating, by circulating recycled combustion gases in a double casing provided around the muffle; a heating zone, provided inside a heat-insulated chamber provided with at least one means for circulating combustion gases around the heating zone of the muffle; and an outlet zone provided with at least one means for controlling the cooling rate of the treated product. For the heat treatment of refractory or carbon-containing products, impregnated with a carbon-containing material such as pitch, the pyrolysis of which produces combustible vapors, the heating zone is divided into three sections by means of an additional partition: a zone for exuding and removing volatile materials from the pitch; a zone for pyrolyzing and carbonizing the pitch; and a final firing zone.

12 Claims, 1 Drawing Figure

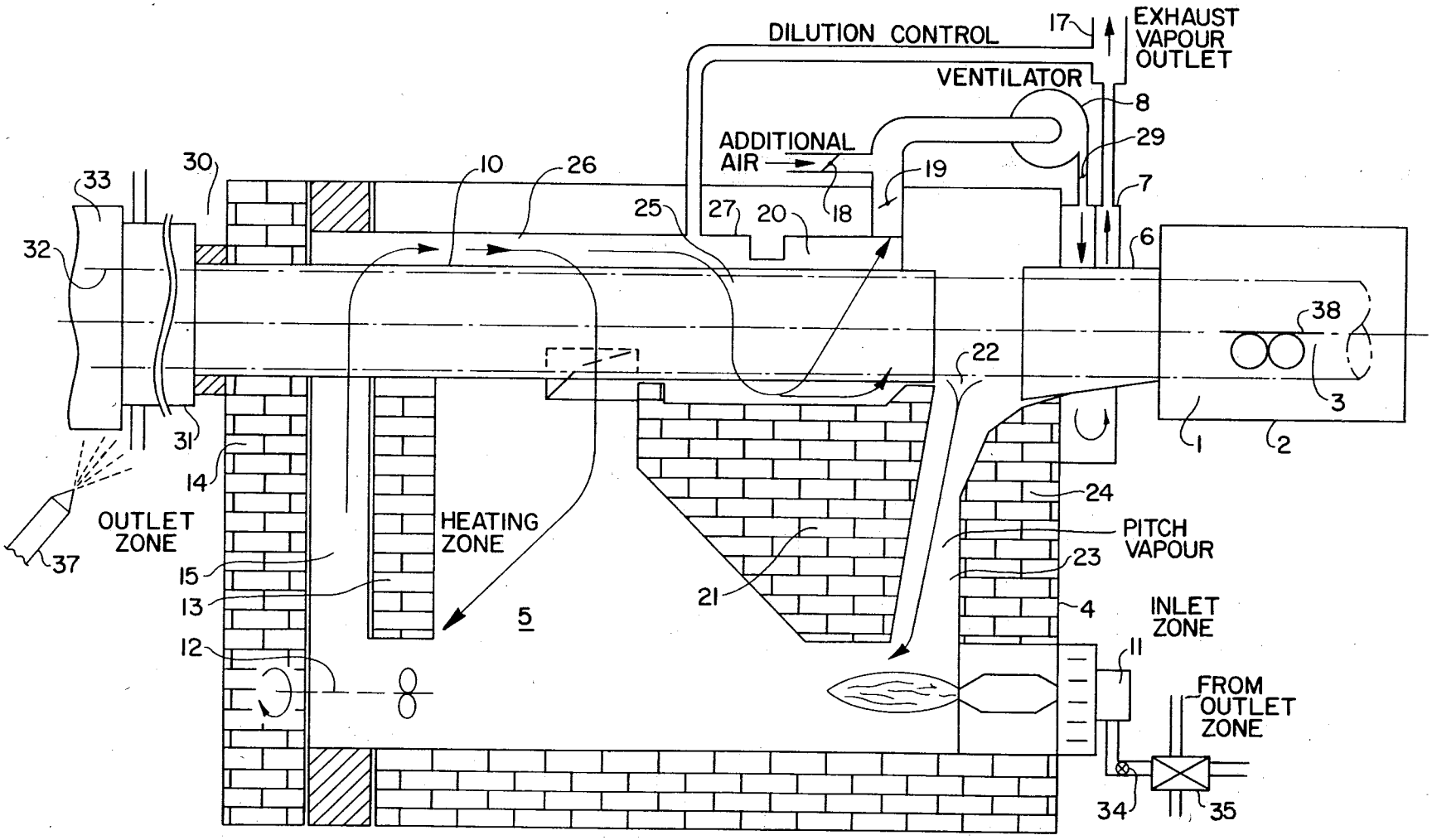
EXHAUST VAPOUR OUTLET
DILUTION CONTROL
VENTILATOR
ADDITIONAL AIR
PITCH VAPOUR
INLET ZONE
FROM OUTLET ZONE
HEATING ZONE
OUTLET ZONE
1
2
3
4
5
6
7
8
10
11
12
13
14
15
17
18
19
20
21
22
23
24
25
26
27
29
30
31
32
33
34
35
37
38

MUFFLE FURNACE FOR CONTINUOUS HEAT TREATMENT

BACKGROUND OF THE INVENTION

This invention relates to a muffle furnace for continuous heat treatment during passage of material therethrough, of products whose production cycle includes a treatment of predetermined duration at elevated temperature. This is the case with certain refractories, carbon-containing products, such as electrodes which are impregnated, after a first firing, with a pyrolyzable and carbonizable carbon-containing material, and also with metals for the purpose of transforming them, and with metal alloys for the purpose of homogenizing them and forming a solid solution with the alloying elements.

In the following, the term "heat treatment" describes any operation in which one of the above products is heated to a high temperature for the purpose of providing it with particular properties.

These heat treatments are often carried out in static electrically heated or flame-heated furnaces. This is the case, for example, with furnaces for reheating metal bilets consisting of various types of steel or aluminum alloys, for example in direct contact with the combustion gases, or furnace chambers for firing carbon electrodes at temperatures of from about 800° to about 1200° C.

These are discontinuous operations which suffer from all the disadvantages associated with these processes: difficulty in controlling the temperature often producing heterogeneous products; prolonged utilization of the furnaces due to the slow speed of the charging and withdrawing operations; and the substantial bulkiness of the equipment. Problems are also caused, in certain cases, by the products to be treated being directly contacted by the combustion gases.

SUMMARY OF THE INVENTION

This invention permits these problems to be overcome. This invention relates to a flame-heated muffle furnace for the continuous heat treatment, during passage of the material, at a temperature which may be from about 1100° to about 1150° C., of products such as refractories, metals and alloys, and carbon-containing products, without the flame or the combustion gases directly contacting the product to be treated.

This furnace comprises: an inlet zone, provided with a means for being preheated by circulating recycled combustion gases in a double casing provided around the muffle; a heating zone provided inside a heat-insulated chamber, provided with at least one means for circulating combustion gases around the heating zone of the muffle; and an outlet zone, provided with at least one means for controlling the cooling rate of the products.

This furnace is particularly well adapted for the heat treatment of refractory or carbon-containing products, impregnated with a carbon-containing material, such as pitch, the pyrolysis of which produces combustible vapors. For this purpose and according to the invention, the heating zone is divided into three sections by means of an additional partition, which three sections comprise:

a zone for exuding and removing volatile materials from the carbon-containing impregnation material, in which the muffle has an aperture opening into a passage delimited by the partition and the outer wall, and the outlet of which is situated in the vicinity of the flame of the burner;

a zone for pyrolyzing and carbonizing the carbon-containing impregnation material; and a final firing zone in which the maximum temperature is reached which is required by the heat treatment and may be from about 1100° to about 1150° C.

BRIEF DESCRIPTION OF THE DRAWING

The FIGURE schematically shows, partially in vertical section, an embodiment of a muffle furnace according to the invention for firing carbon-containing products impregnated with pitch, provided with a device for recovering the pitch vapors, the combustion of which enables a saving of up to about 90% of the fuel being supplied to the burner.

DETAILED DESCRIPTION OF THE INVENTION

The furnace comprises an inlet zone, consisting of a tunnel 1 provided with a removable cover 2 in which the product 3 to be treated by heat is introduced by conventional handling means, such as by a powered or unpowered roller conveyor, shown schematically as 38. The furnace itself consists of a substantially parallepiped insulating refractory chamber 4 which forms the combustion chamber 5.

The inlet of the furnace comprises a preheating section 6 consisting of a double casing 7 in which circulate the hot gases recovered in the combustion zone and circulated by the recycling ventilator blower 8.

In the following, the term "combustion gas" defines the combustion gases originating directly from the burner, and the gases circulated in the different circuits of the furnace, whether these gases are pure or diluted by the surrounding air to reduce their temperature.

The muffle itself is a cylindrical tube 10 arranged horizontally in the upper section of the furnace. It is of refractory steel, preferably containing a large quantity of nickel, so that it can withstand operating temperatures of as high as about 1100° to about 1150° C., it being understood that this temperature range is not a limitation of the invention.

The inner cross-section of the furnace is slightly greater, by from 5 to 20% for example, than the maximum outer diameter of the products to be treated or, should the case arise, of the container filled with products to be treated. Inside the muffle 10, two longitudinal rails ensure that the products are guided as they pass through from right to left in the case shown.

The product to be treated is generally passed through by pushing or power operation of the conveyor, the forward movement of the product being continuous or intermittent, depending on the requirements of the treatment being carried out.

The furnace is heated by a gaseous, liquid or powdered solids fuel burner 11, provided with a controllable air inlet 34, which is optionally over-dimensioned for reasons which will be explained in the following description, and it is also possible to supply preheated air by an exchanger 35 positioned in the combustion or cooling gas circuit of the outlet zone.

The combustion gases are circulated by the ventilator or fan 12 and the partition 13. The arrows show, in an approximate manner, the path of the combustion gases.

The partition 13 defines with the outer wall 14, a passage 15 which opens into the muffle in the transition zone between the heating zone 26 and the outlet zone. The combustion gases circulate around the muffle along a path which is approximately shown by the arrows, thereby ensuring noteworthy homogeneity of temperature in this entire section of the muffle.

In accordance with conventional processes, one or more devices for recycling the combustion gases and optionally introducing surrounding air by means of the flaps, or dampers, 18, 19, 29 are provided in the circuit for removing exhaust vapors via the chimney 17 for the purpose of supplying the double casing 7 of the preheating zone 6 with hot gas, and, should the case arise, supplying the buner 11 with preheated air. The structure of the recycling circuit is exemplary and is not intended to limit the invention.

The furnace, which is the subject of the invention, is particularly well adapted for the particular situation where the products to be treated by heat are carbon-containing refractory products impregnated with a carbon containing material such as pitch, the pyrolysis of which produces combustile vapors. Indeed it is known that certain products destined to be used under severe mechanical conditions have to be subjected to an impregnation phase with pitch, for example, which provides them after firing, with greater mechanical strength, improved tightness, e.g. lower porosity, and, in the case of carbon-containing products, greater electrical conductivity. This is the case, in particular, with carbon or graphite electrodes intended for use in electrometallurgy wherein after a first firing the products are: cooled; impregnated with pitch under pressure and at a temperature of about 200° C.; and then re-fired to carbonize the pitch retained during impregnation. This is also the case for certain magnesium oxide bricks which are impregnated with pitch then re-fired.

The heating zone is divided into three sections, according to the invention by means of an additional partition 21, which three sections comprise:

a zone for exuding and removing volatile materials from the carbon-containing impregnation material, e.g., pitch, in which the muffle comprises an aperture 22 opening into a passage 23 delimited by the partition 21 and the outer wall 24, and the outlet of which is situated in the vicinity of the flame of the burner 11;

a zone 25 for pyrolyzing an decarbonizing the carbon-containing impregnation material; and a final heating or firing zone 26 in which the maximum temperature is reached which is required by the heat treatment and may be from about 1100° to about 1150° C.

The possibility of regulating the temperature in the pyrolysis zone is a particularly advantageous characteristic of this invention. Indeed, in order to obtain the maximum carbonization yield of the impregnated product the speed at which the temperature of the impregnated product rises and the holding time at a predetermined temperature have to be precisely determined, this being easily carried out in the muffle furnace which forms the subject of the invention.

The volatile materials which are freed from the carbon-containing impregnation material throughout the pyrolysis, and the pitch which is volatized from the electrodes 3, escape via the opening 22 and the passage 23 and reach the flame of the burner 11 where they are burned owing to the supply of excess air, preheated or otherwise, to the burner. As will be seen in the example, up to 90% of the fuel supplied to the burner can thereby be saved when the furnace is in a heated state. The combustion gases are recylced and the calories which they contain are recovered.

The preheating zone 7 is suppliled with combustion gases which are optionally diluted with surrounding air. The pyrolyzing and carbonizing zone 25 comprises a double casing 27 in which there circulate the combustion gases originating in the final firing zone, which are optionally diluted by surrounding air and/or combustion gases from the preheating zone.

The combustion gases are removed via the chimney 17. Flaps, or dampers, such as 18, 19 permit the necessary control of rate of flow.

The outlet zone is provided with controlled cooling means, whether decelerated or accelerated, depending on the requirements of the treated product and the heat treatment cycle used.

The section of the muffle 30 projecting into the outlet zone can either be heat-insulated such as by insulation 36, or exposed to open air over its entire length or over part of its length, or subjected to cooling by forced ventilation, and optional recovery of hot air to feed the burner, or by suction or spraying application of a fluid, such as water, such as by spraying means 37.

Different cooling control devices can be provided beyond and up to the outlet of the muffle, such as a double casing 31 with circulation of a liquid or gaseous fluid, or in contrast, static insulation, for example if a metal billet for supplying a hot extrusion press is being treated, or a combination of insulation at the outlet of the hot zone followed by an accelerated cooling zone.

The outlet can also have, symmetrically with the inlet, an outlet tunnel 32 with a removable cover 33 for extracting the treated product.

It is possible to create a controlled atmosphere in the muffle by circulting an inert gas, such as argon or nitrogen, and by providing, if necessary, sealing means at the inlet and the outlet.

EXAMPLE

A furnace is constructed, in accordance wih FIG. 1, for re-firing electrodes, nipple bars and tubes for use in the chemical industry which are impregnated with pitch and all of which have an outer diameter of 300 mm. The muffle has an inner diameter of 350 mm. The speed at which the products pass through is controllable between 0.2 and 2 meters per hour. It is adjusted as a function of the temperature of the different zones so as to produce a temperature at the core of the product to be treated of from about:

200° to 300° C. at the outlet of the preheating zone;
350° to 450° C. at the outlet of the pyrolyzing zone; and
800° to 950° C. at the outlet of the final firing zone.

When the furnace is in operation, it operates with an external fuel supply of about 200 thermies (836 MJ) per tonne of product to be fired, while, in modern static furnaces, this consumption is about 1800 thermies/-tonne (7524 MJ), and at best does not fall to less than 600 thermies/tonne with other types of static furnaces, that is a fuel saving of about 90%. Furthermore, the rate at which the temperature of electrodes with a diameter of 300 mm rises may reach 150° C. per hour, while a rate of 12° to 15°/hr is hardly exceeded in static furnaces and a rate of at most from 40° to 50° C. hr is hardly exceeded in furnaces where the products are in direct contact with the flame.

The muffle extends outside the chamber 4 of the furnace by several meters. In a first zone, the muffle is cooled spontaneously in the surrounding air. In the second zone, the muffle is cooled by the circulation of cold water in the double casing 31. As they emerge, the produces are at a temperature of less than 400° C.

After graphitizing under conventional conditions, the products obtained in this process have characteristics which are entirely comparable with and even slightly superior to those obtained in conventional chamber furnaces of the "Riedhammer" type, for example, as the following Tables show:

| | Static Firing Chamber Furnace | According to the Invention |
|---|---|---|
| Nipple bar | | |
| Apparent density | 1.79 | 1.78 |
| Breaking load | 7.25 MPa | 8.06 MPa |
| Tubes for Use in the Chemical Industry | | |
| Permeability | 602 $cm^3.s^{-1}$ | 543 $cm^3.s^{-1}$ |
| Transverse expansion, | $4.82.10^{-6}$ | $4.74.10^{-6}$ |
| Longitudinal bending | 22.3 MPa | 26.9 MPa |

In conclusion, this invention is applicable to the treatment of certain particular refractory products, such as magnesium bricks or mouldings impregnated with pitch, of crude carbon-containing products, and different types of cylindrical carbon-containing products, such as electrodes, nipple bars, tubular products for use in the chemical industry and also to products having smaller dimensions, such as carbons for electric cells which are introduced in a crude state, as extruded, packed in open containers of refractory steel, thereby permitting the operation to be carried out in the same cylindrical muffle. It is clear that it is also possible to adapt the shape and dimensions of the muffle to those of the products to be treated.

Likewise, the furnace permits the firing of any carbon-containing or refractory product, impregnated with a pyrolyzable material producing, as does pitch, combustible vapors. This is particularly the case with organic polymer-based resins, such as phenol-formaldehyde and polymethacrylates, to name only the best known.

In various cases, it enables the pyrolysis and carbonization of the impregnation product to be controlled precisely, perfectly homogeneous refractory products to be obtained and up to 90% of the energy required in most static furnaces of equal performance to be saved.

However, it is also possible to use this furnace for the treatment of products other than those impregnated with pitch, such as metal and alloyed bars and billets of aluminum, copper or iron base, for example.

In the heat treatment of metal billets or plates, the heating zone ensures a constant and homogeneous treatment temperature over the entire length of each billet which enables homogenizing treatment for forming a solid solution or annealing, pre-extrusion heating, forging, impact forging, or even rolling treatments to be carried out under ideal conditions with a precision of temperature to the degree.

Of course, in this case where there is no pyrolyzable material, there is no benefit from the energy supply due to the combustion of volatile products emitted by the carbon-containing products impregnated with pyrolyzable materials, but the homogeneity of temperature, the rigorous control thereof and the absence of contact between the products to be fired and the combustion gases are very attractive characteristics. By way of example, in a furnace corresponding to the design of the FIGURE, billets of type 7075 aluminum-based alloy, with a diameter of 300 mm and having the following composition are treated:

zinc: 5.6%
magnesium: 2.5%
copper: 1.6%
chromium: 0.30%
aluminum: remainder

The billets, as continually cast, are homogenized by heating to a temperature of 485° C., then, on emerging from the furnace, the outlet zone of which is heat-insulated, are directly introduced into the container of an extruding press; the temperature of the billet in the container is 455° C.

In the same manner it is possible to re-heat to 850° C. copper billets, with the circulation of nitrogen, for the purpose of supplying a piercing mill for the production of blanks for the production, by subsequent rolling and drawing, of copper tubes.

In conclusion, although the furnace is described in the particular case where the muffle is cylindrical, it is clear that its cross-section may be square or rectangular if profiles having a cross-section other than circular only are to be treated.

We claim:

1. A muffle furnace for continuous heat treatment, during passage of the material, of refractory and carbon-containing products which are impregnated with a carbon-containing material the pyrolysis of which produces combustible vapors, the production cycle of these products having a passage of predetermined duration at a temperature which may be from about 1100° to about 1150° C., the furnace being heated by a flame burner without combustion gases directly contacting the products to be treated, and comprising the following zones through which said muffle passes:

(a) an inlet zone defined by a double casing (7) provided around the muffle (10), through which recycled combustion gases circulate to serve as a heating means in indirect heat exchange relationship;

(b) a heating zone defined by a heat-insulated chamber (4), provided with said flame burner and at least one means (12) for circulating the combustion gases around the muffle portion passing through said chamber; and (c) an outlet zone provided with at least one means for controlling the cooling rate of the treated products;

wherein said chamber includes a partition (21) which divides the heating zone into three sections comprising, in the direction of movement of material through the muffle:

(d) a zone for volatizing and removing volatile materials from the carbon-containing impregnated material, in which zone the muffle comprises an aperture (22) opening into a passage delimited by the partition (21) and an outer wall (24) of the furnace, said passage having an outlet which is situated in the vicinity of the flame of the burner (11), whereby said volatile materials are combusted by the burner flame to provide heat in said heating zone;

(e) a zone (25) for pyrolyzing and carbonizing the carbon-containing impregnated material; and (f) a final firing zone (26) in which the maximum temperature of from about 1100° to about 1150° C. required for the heat treatment is reached, and wherein said means for circulating the combustion gases comprises:

(g) a fan (12); and (h) a separating partition (13) within said heat insulated chamber, which defines with a wall (14) of the furnace, a passage (15) having one end opening into the heat insulated chamber and the other end opening adjacent said muffle in a transition region between said heating zone and said outlet zone.

2. A furnace according to claim 1, wherein said combustion gases are circulated in a direction counter-current to the movement of the material through the furnace, and wherein the pyrolyzing and carbonizing zone (25) comprises a double casing (27) in which there circulate the combustion gases passing from the final firing zone.

3. A furnace according to claim 2, wherein the circulating combustion gases are diluted by the surrounding air and/or the combustion gases from the preheating zone.

4. A furnace according to claim 1, comprising means for preheating combustion air to be supplied to the burner.

5. A furnace according to claim 1, wherein the burner is provided with a means for supplying additional air for ensuring the combustion of the vapors and the carbon-containing impregnation material.

6. A furnace according to claim 1, wherein the means for controlling the cooling rate of the products consists of an insulation provided around at least one section of the length of the outlet zone.

7. A furnace according to claim 1, wherein the means for controlling the cooling rate is a double casing provided around at least one section of the length of the outlet zone, and in which there circulates a fluid selected from liquid, gaseous and vaporized fluid.

8. A furnace according to claim 1, wherein the means for controlling the cooling rate consists of means for application of a fluid.

9. A furnace according to claim 1, including pushing means which ensures the forward movement of the product to be treated in the muffle.

10. A furnace according to claim 9, wherein the pushing means act in a continuous manner on the product being treated.

11. A furnace according to claim 9, wherein the pushing means acts stepwise on the product being treated.

12. A furnace according to claim 1, wherein the products to be treated are arranged in open containers.

* * * * *